US010632341B2

(12) United States Patent
Liu

(10) Patent No.: US 10,632,341 B2
(45) Date of Patent: Apr. 28, 2020

(54) CLIMBING MACHINE

(71) Applicant: Dyaco International Inc., Taipei (TW)

(72) Inventor: Han-Lin Liu, Taipei (TW)

(73) Assignee: Dyaco International Inc., Taipei (TW)

( * ) Notice: Subject to any disclaimer, the term of this patent is extended or adjusted under 35 U.S.C. 154(b) by 40 days.

(21) Appl. No.: 16/110,951

(22) Filed: Aug. 23, 2018

(65) Prior Publication Data

US 2020/0038706 A1 Feb. 6, 2020

(30) Foreign Application Priority Data

Aug. 1, 2018 (TW) ..... 107126699 A

(51) Int. Cl.

| | |
|---|---|
| ***A63B 22/04*** | (2006.01) |
| ***A63B 21/22*** | (2006.01) |
| ***A63B 22/00*** | (2006.01) |
| ***A63B 21/00*** | (2006.01) |

(52) U.S. Cl.

CPC ..... *A63B 22/04* (2013.01); *A63B 21/00069* (2013.01); *A63B 21/225* (2013.01); *A63B 22/001* (2013.01); *A63B 22/0005* (2015.10); *A63B 22/0015* (2013.01); *A63B 22/0046* (2013.01)

(58) Field of Classification Search

CPC ..... A63B 22/04; A63B 22/0048–0074; A63B 22/0005; A63B 22/001

See application file for complete search history.

(56) References Cited

U.S. PATENT DOCUMENTS

| | | | | |
|---|---|---|---|---|
| 6,017,294 | A * | 1/2000 | Eschenbach | A63B 22/001 482/51 |
| 6,440,046 | B1 * | 8/2002 | Tholkes | A61G 5/14 280/250.1 |
| 9,849,332 | B1 * | 12/2017 | Huang | A63B 21/4034 |
| 2011/0281690 | A1 * | 11/2011 | Van Straaten | A63B 21/015 482/52 |
| 2016/0263431 | A1 * | 9/2016 | Huang | A63B 22/0056 |
| 2017/0036062 | A1 * | 2/2017 | Huang | A63B 71/0622 |

* cited by examiner

*Primary Examiner* — Jennifer Robertson

(74) *Attorney, Agent, or Firm* — Donald E. Stout; Stout, Uxa & Buyan, LLP

(57) ABSTRACT

This invention discloses a climbing machine. Without being limited by the structure of the climbing assembly, the upper limbs and the lower limbs of the user can have different moving paths. In addition, the climbing machine also has the advantages of rapid response, wide range of resistance adjustment, and smooth operation.

10 Claims, 9 Drawing Sheets

CLIMBING MACHINE

CROSS-REFERENCE TO RELATED APPLICATIONS

The entire contents of Taiwan Patent Application No. 107126699, filed on Aug. 1, 2018, from which this application claims priority, are expressly incorporated herein by reference.

BACKGROUND OF THE INVENTION

1. Field of the Invention

The present invention relates to an exercise machine, and more particularly relates to a climbing machine.

2. Description of Related Art

Climbing is a sport derived from mountaineering and is an activity of using one's hands, feet, or any other part of the body to ascend a steep object. Climbing can strengthen core muscles and has many benefits for the body.

Taiwan Patent No. 1621465B discloses a climbing machine comprising a base, a damping device, two climbing simulators, and two pedaling structures. The damping device is mounted on the base and has two sides with each connecting to a pedaling structure. The two climbing simulators are vertically disposed on both sides of the damping device. Each climbing simulator includes a track and a holding device being slidably disposed in the track and being connected to the corresponding pedaling structure through two connecting rods. In addition, a pulley is disposed above each track and engages with a belt, which includes two terminals with each connecting one holding device, so that the two holding devices are pulled with each other and are alternately moved up and down.

Taiwan Patent No. M549640U discloses a climbing mechanism comprising two upright rails, two sliding sets, a linkage mechanism, and a magnetic-controlled damping device. Each sliding set includes a slider, a handle, and a pedal. The slider is placed in the track with rollers on both sides to allow it to slide up and down within the track. The upper end of the slider is connected to the handle, and the lower end is connected to the pedal. The linkage mechanism has components such as a sprocket and a steel rope so that the two sliders can be pulled with each other. The magnetic-controlled damping device is coaxially coupled to the sprocket to provide the damping strength during training.

Taiwan Patent M548568U discloses a climbing/fitness combine machine, which combines a climbing machine and a flywheel fitness machine sharing a support frame and a base. The climbing machine includes a climbing drive, two climbing handles, and two climbing pedals. The climbing handles and the climbing pedals are disposed above and below and disposed at the left side and a right side of the climbing drive, and can be alternately moved up and down.

Conventional climbing machines are characterized in that the moving paths of the holders and the pedals are limited by the structure of the rail or track. Both moving paths of the holders and the pedals are straight line, which is less ergonomic in operation. In addition, Conventional climbing machines allow the two holders to be pulled up and down through a belt or a steel rope. This design has disadvantages of long response time and non-smooth operation.

SUMMARY OF THE INVENTION

In one general aspect, the present invention relates to a climbing machine with quick response and smooth operation.

In an embodiment of the present invention, a climbing machine is provided with a frame, two first rock arms, two second rock arms, two pedals, a resistance device, two cranks, two bridge rods, two sliding rods, and two climbing assemblies. The frame comprises a base on a supporting plane or ground, a main frame on the base, and a supporting frame on the main frame. The two first rock arms are respectively arranged at a left side and a right side of the frame, and each first rock arm has a first end pivotally coupling with an axis of the main frame. The two second rock arms couple with the two first rock arms, each first rock arm having a second end pivotally coupling with a first end of one corresponded second rock arm, each second rock arm having a roller at its outer side surface. The two pedals couple with the two second rock arms, each second rock arm having a second end coupling with one corresponded pedal. The resistance device is pivoted to the main frame by an axle for providing a resistance. The two cranks are respectively arranged at a left side and a right side of the resistance device, each crank having a first end coupling with the axle of the resistance device. The two bridge rods couple with the two cranks and the two second rock arms, each bridge rod having a first end and a second end, the first end of each bridge rod coupling with a second end of one corresponded crank, the second end of each bridge rod being pivoted to a first pivot of one corresponded second rock arm. Each sliding rod has a first end coupled with the main frame and a second end coupled with the base, each second rock arm movably coupling with one corresponded sliding rod via the roller. The two climbing assemblies couple with the two second rock arms, each climbing assembly comprising a handle, an inner tube, an outer tube, and a connecting rod, wherein the outer tube is fixed to a left side or a right side of the supporting frame, the inner tube is movably disposed in the outer tube, the handle is connected to an upper end of the inner tube, a lower end of the inner tube is pivotally connected to a first end of the connecting rod, and a second end of the connecting rod is pivoted to a second pivot of one corresponding second rock arm.

In one embodiment, the second pivot comprises a rod end bearing.

In one embodiment, each climbing assembly further comprises a plurality of adjusting assemblies, and each of the plurality of adjusting assemblies comprises a plurality of fixed wheels configured to fit an outer surface of the inner tube.

In one embodiment, each adjusting assembly comprises two fixed wheels and two adjusting wheels. The two fixed wheels are pivotally mounted on a pedestal at a side of the outer tube, each of the two fixed wheels passing through a corresponded opening of the outer tube and being in contact with the inner tube. The two adjusting wheels are disposed on the outer surf ace of the outer tube opposite to the two fixed wheel. The adjusting device couples to the two adjusting wheels for adjusting a gap or tightness between the two adjusting wheels and the inner tube.

In one embodiment, the adjusting device comprises an adjusting member and an adjusting bolt. The adjusting in ember is pivotally mounted on a convex structure protruded from surface of the outer tube. The adjusting bolt passes through a first end of the adjusting in ember and connects to the outer tube. The two adjusting wheels are pivotally mounted on a left side and a right side of a second end of the adjusting member, each adjusting wheel passing through one corresponded opening of the outer tube and abutting against the inner tube.

In one embodiment, the inner tube and the outer tube are rectangle-shaped or square-shaped.

In one embodiment, the inner tube and the outer tube are circle-shaped or ellipse-shaped or have a shape combined with rectangle and arc.

In one embodiment, each adjusting assembly comprises two fixed wheels and two adjusting wheels. The two fixed wheels are pivotally mounted on a first pedestal at a first side of outer surface of the inner tube. The two adjusting wheels are pivotally mounted on a second pedestal at a second side of outer surface of the inner tube, wherein the first side is opposite to the first side, and the two adjusting wheels are configured to fit the outer surface of the inner tithe and the inner surface of the outer tube.

In one embodiment, the resistance device comprises a driving wheel and a flywheel. The driving wheel has the axle that includes a bidirectional bearing coupling with the first end of the two cranks. The flywheel couples to the driving wheel via a connecting member.

In one embodiment, each of the two sliding rods is arc-shaped.

According to the climbing machines provided by the present invention, the inner tube can be maintained at an appropriate position and the friction between the inner tube and outer tube can be reduced. In addition, the mowing path of the pedals is not limited to the configuration of the climbing assembly. The operation of the climbing machine can be more realistic.

Furthermore, the alternate up and down movements of the two climbing assemblies are driven by the two cranks through the connection between the pedal and the axle of the resistance device. The 180 degree arrangement of the two cranks can drive the two climbing assemblies to alternately move up and down. In contrast, conventional climbing machines make two handles to alternately move up and down through a belt or a steel rope. Compared with the prior art, the climbing machines of this invention have a fast response time, a smooth operation, and a wide range of resistance adjustment suitable for users with different body types.

DETAILED DESCRIPTION OF THE PREFERRED EMBODIMENT

Figure 1:
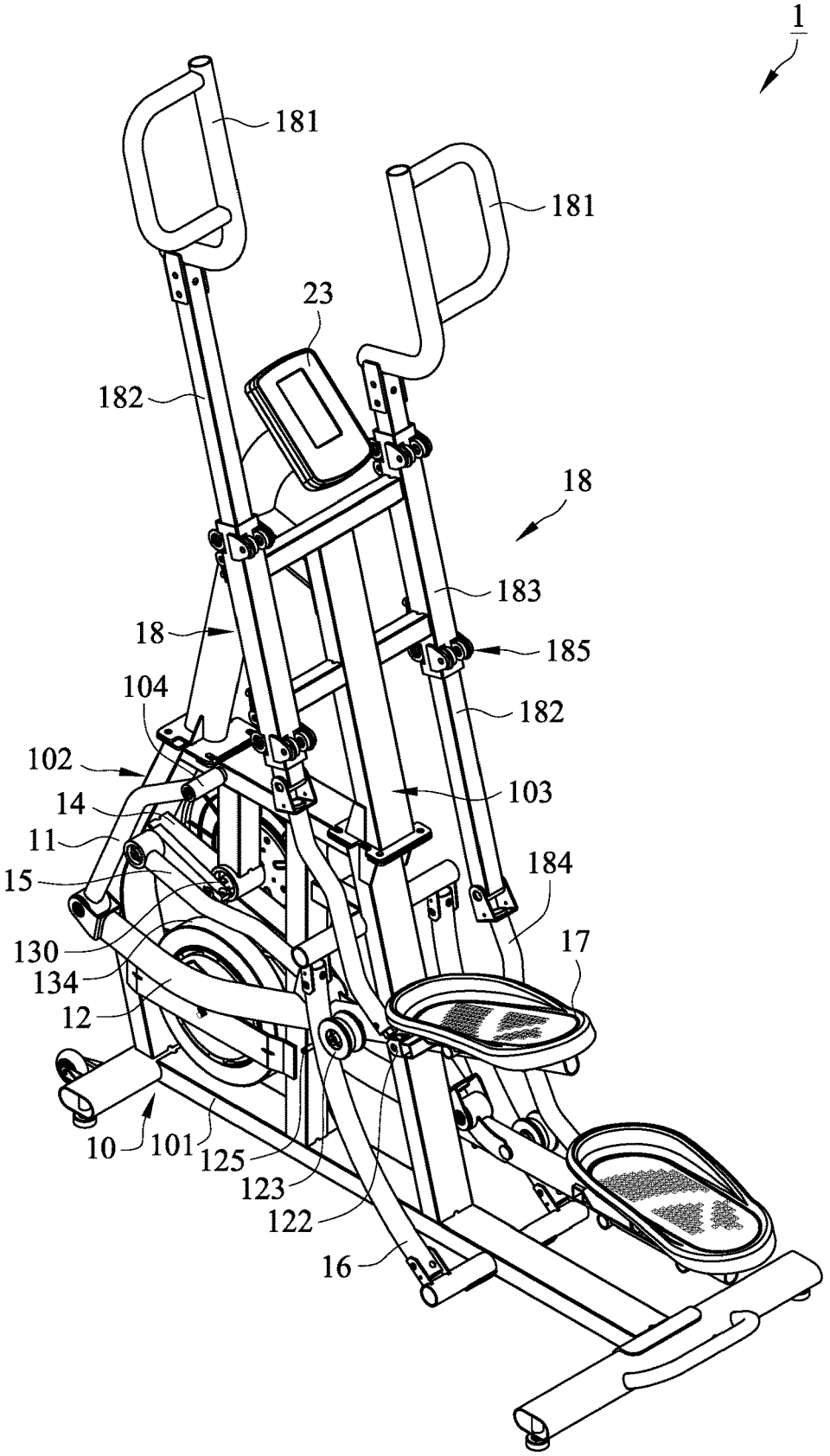
FIG. 1 is a perspective view showing a climbing machine according to a first embodiment of the present invention.

Embodiments of the invention are now described and illustrated in the accompanying drawings, instances of which are to be interpreted to be to scale in sonic implementations while in other implementations, for each instance, not. In certain aspects, use of like or the same reference designators in the drawings and description refers to the same, similar or analogous components and/or elements, while according to other implementations the same use should not. According to certain implementations, use of directional terms, such as, top, bottom, left, right, up, down, over, above, below, beneath, rear, front, clockwise, and counterclockwise, are to be construed literally, while in other implementations the same use should not. While the invention will be described in conjunction with these specific embodiments, it will be understood that it is not intended to urn it the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components.

Figure 2:
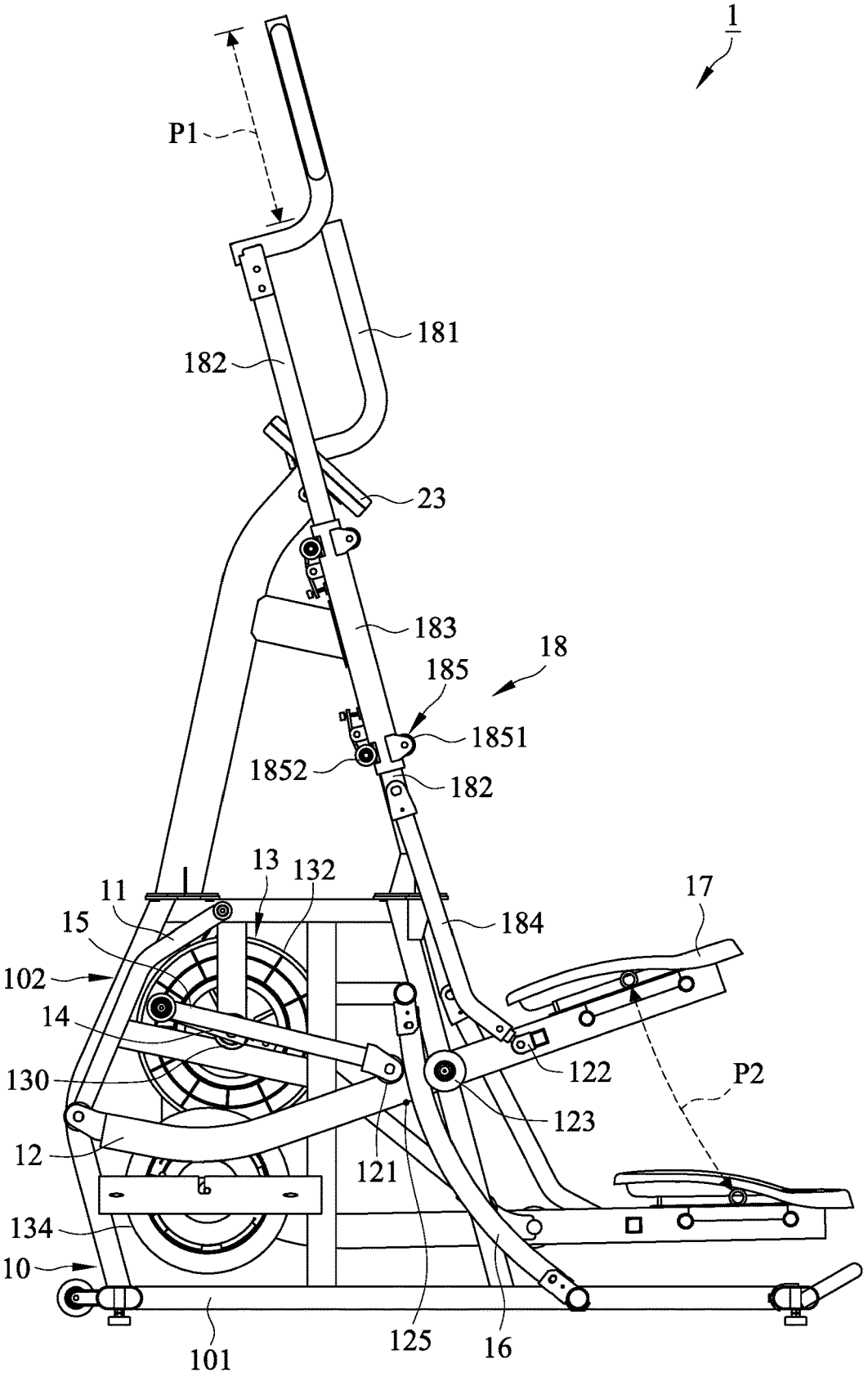
FIG. 2 is a side view showing the climbing machine according to the first embodiment of the present invention.

FIGS. 1 and 2 are perspective and side view showing a climbing machine 1 according to a first embodiment of the present invention.

Referring to FIGS. 1 and 2, the climbing machine 1 comprises a frame 10, two first rock arms 11, two second rock arms 12, a resistance device 13, two cranks 14, two bridge rods 15, two sliding rods 16, two pedals 17, and two climbing assemblies 18.

Referring to FIGS. 1 and 2, in this preferred embodiment, the frame 10 may comprise, but is not limited to, a base 101, main frame 102, and a supporting frame 103. The base 101 is placed on a supporting plane or ground. The main frame 102 is arranged on the base 101, and the supporting frame 103 is arranged on the main frame 102. In this preferred embodiment, an operating interface 23 is disposed at an upper end of the main frame 102 for allowing the user to control the resistance of the climbing machine 1.

Referring to FIGS. 1 and 2, both the two first rock arms 11 and the two second rock arms 12 are arranged at a left side and a right side of the frame 10, respectively. Each first rock arm 11 and each second rock arm 12 include two ends, a first end and a second end, in which the first end of the first rock arm 11 pivotally couples with an axis 104 of the main frame 102, and the second end of the first rock arm 11 pivotally couples with the first end of one corresponded second rock arm 12. And the second end of the corresponded second rock arm 12 couples with one corresponded pedal 17.

Referring to FIGS. 1 and 2, the two cranks 14 are respectively arranged at a left side and a right side of the resistance device 13. The resistance device 13 comprises an axle 130, and each of the two cranks 14 and two bridge rods 15 includes two ends, a first end and a second end. The first end of each crank 14 couples with the axle 130, and the second end of each crank 14 pivotally couples with the first end of one cones ponded bridge rod 15. And the second end of the corresponded bridge rod 15 pivotally couples with a first pivot 121 of one corresponded second rock arm 12. In addition, each sliding rod 16 includes a first end and a second end, in which the first end movably couples with the main frame 18, and the second end couples with the base 101.

Referring to FIGS. 1 and 2, the resistance device 13 gives a resistance to the user through the connected two pedals 17. The operating interface 23 mounted above the frame 10 can determine the resistance. In this preferred embodiment, the resistance device 13 may comprise, but is not limited to, a driving wheel 132 and a flywheel 134. The driving wheel 132 has the axle 130 that includes a bidirectional bearing (not shown) coupling with the first end of the two cranks 14. The motion of the pedals 17 will drive the driving wheel 132, which then drives the flywheel 134 to rotate via a connecting member (e.g., belt, not shown).

Referring to FIGS. 1 and 2, each second rock arm 12 includes a roller 123, which is disposed at the outer side surface between the first end and second end of the second rock arm 12. The roller 123 includes concave surface to fit the sliding rod 16, so that the roller 123 can move along the curved shape of the sliding rod 16 between its upper end and lower end. In addition, a limit bar 125 may be disposed between the two ends of each second rock arm 12, and is disposed adjacent to the sliding rod 16 and protrudes from the outer side surface of the second rock arm 12, so that the sliding rod 16 is sandwiched between the roller 123 and the limit bars 125, which can prevent the roller 123 from being detached from the sliding rod 16.

Referring to FIGS. 1 and 2, two climbing assemblies 18 are respectively disposed at the left side and the right side of the supporting frame 103. Each of the two climbing assemblies 18 includes a handle 181, an inner tube 182, an outer tube 183, and a connecting rod 184. The outer tube 183 is fixed at a side of the supporting frame 103. The inner tube 182 is movably disposed in the outer tube 183. The handle 181 is connected to the upper end of the inner tube 182, and the lower end of the inner tube 182 is pivotally connected to the first end of the connecting rod 184. The second end of the connecting rod 184 is pivoted to a second pivot 122 of the outer side surface between the two ends of the corresponding second rock arm 12. In an embodiment, the second pivot 122 includes a rod end bearing.

Figure 3:
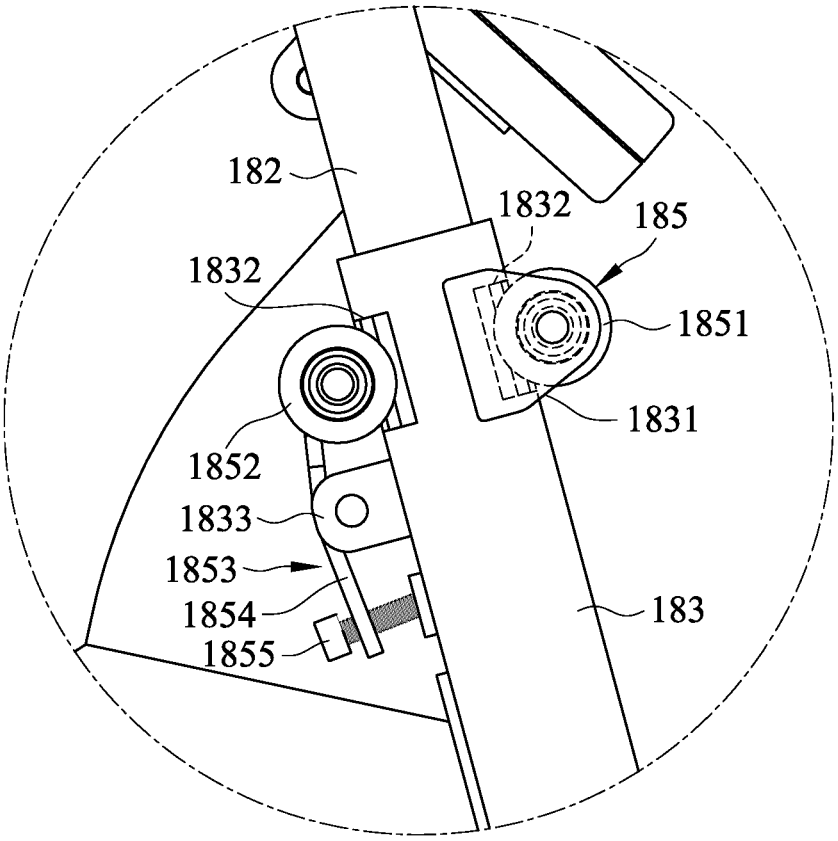
FIG. 3 is a partially side view showing a climbing assembly of the climbing machine according to the first embodiment of the present invention.
Figure 4:
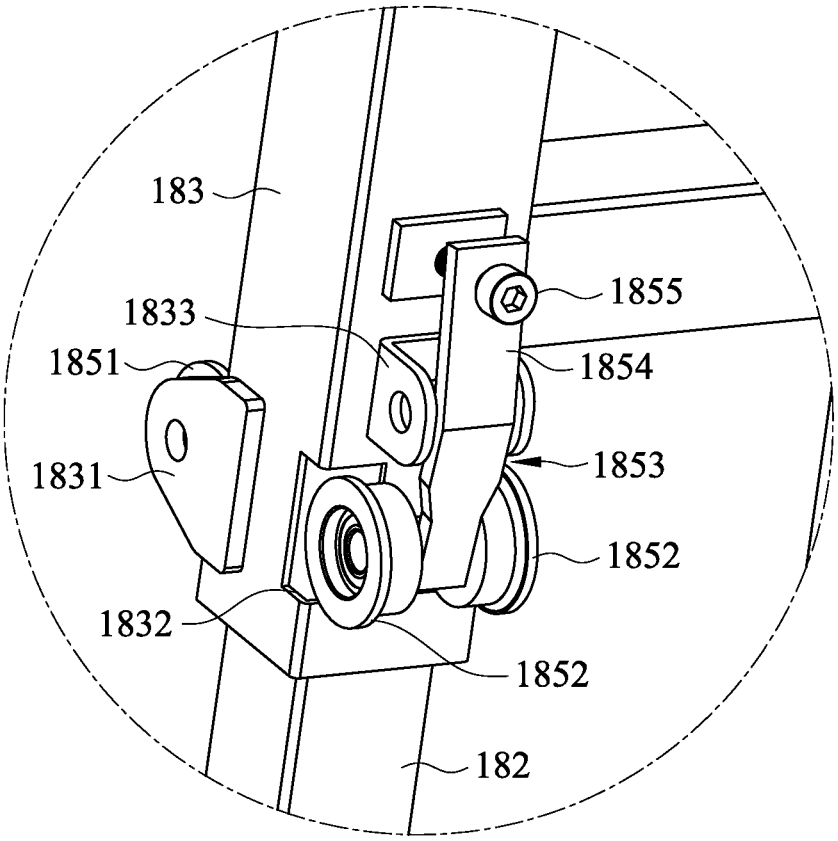
FIG. 4 is a partially perspective view showing the climbing assembly of the climbing machine according to the first embodiment of the present invention.

Referring to FIGS. 1 and 2, each climbing assembly 18 further includes a plurality of adjusting assemblies 185. FIGS. 3 and 4 are partially side and perspective views showing the climbing assembly 18 of the climbing machine 1 in accordance with the first embodiment of the present invention. Referring to FIGS. 1-4, in the present embodiment, each climbing assembly 18 includes two adjusting assemblies 185. Each adjusting assembly 185 includes two fixed wheels 1851, two adjusting wheels 1852, and an adjusting device 1853. In this embodiment, the two fixed wheels 1851 are pivotally mounted on the pedestal 1831 at a side of the outer tube 183. The outer tube 183 has openings 1832. The fixed wheel 1851 passes through the corresponded opening 1832, and is in contact with the inner tube 182. The adjusting device 1853 is disposed on the outer surface of the outer tube 183 opposite to the fixed wheel 1851. The adjusting device 1853 includes an adjusting member 1854 and an adjusting bolt 1855. The adjusting member 1854 is pivotally disposed on the convex structure 1833 protruded from the surface of the outer tube 183. The adjusting bolt 1855 passes through a first end of the adjusting member 1854 and is connected to the outer tube 183. The two adjusting wheels 1852 are pivotally mounted on the left side and right side of a second end of the adjusting member 1854. The outer tube 183 includes an corresponded opening 1832 through which the adjusting wheel 1852 passes, and the adjusting wheel 1852 abuts against the inner tube 182. Thereby, by rotating the adjusting bolt 1855, the gap or tightness between the adjusting wheel 1852 and the inner tube 182 can be adjusted.

Figure 5:
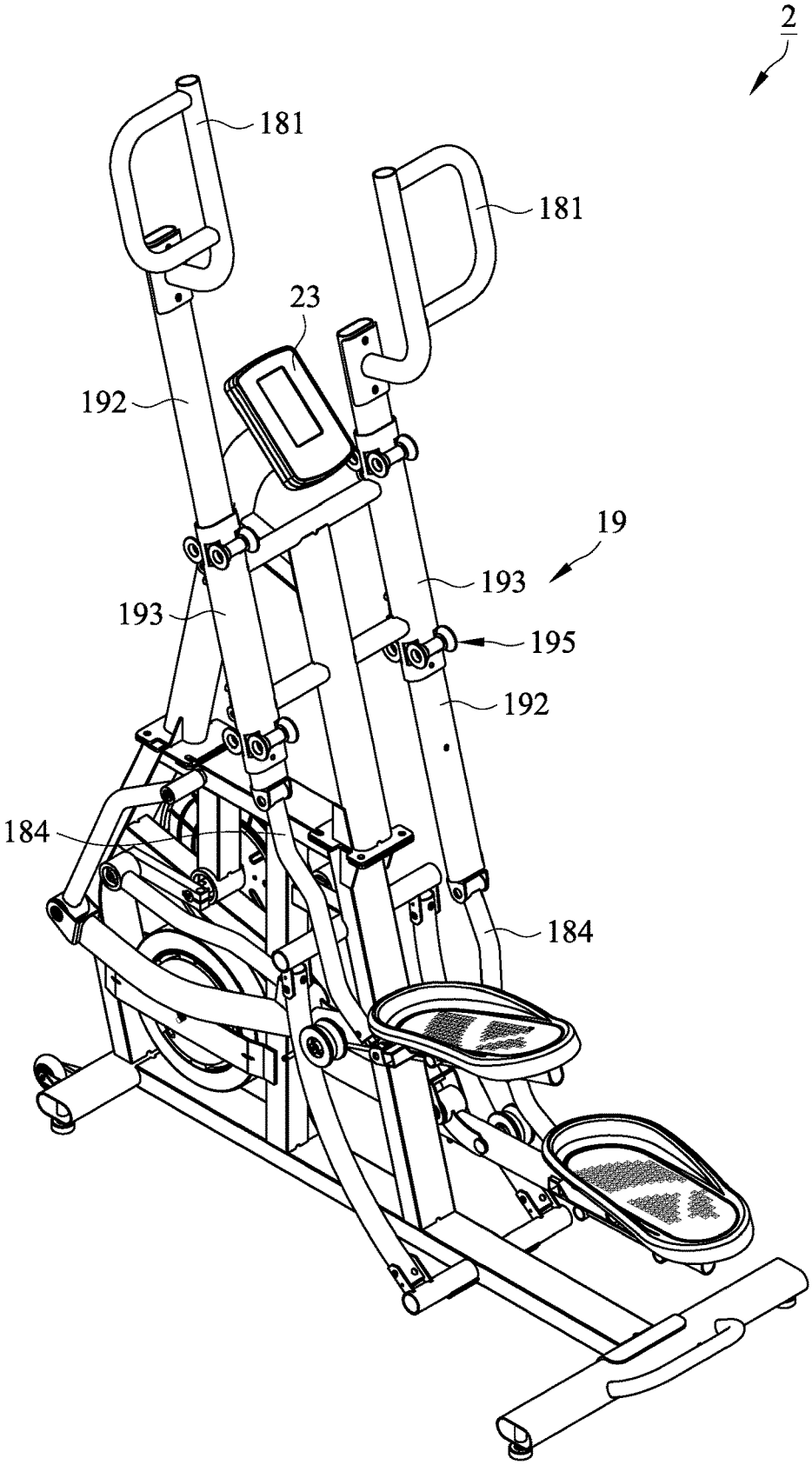
FIG. 5 is a perspective view showing a climbing machine according to a second embodiment of the present invention.
Figure 6:
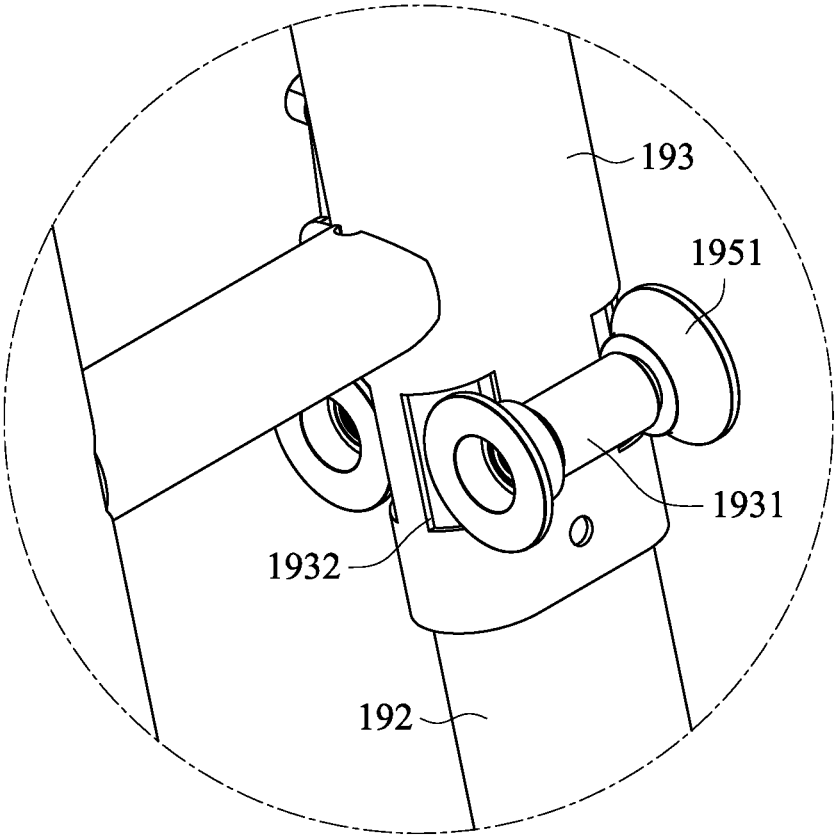
FIG. 6 is a partially perspective view showing the climbing assembly of the climbing machine according to the second embodiment of the present invention.
Figure 7:
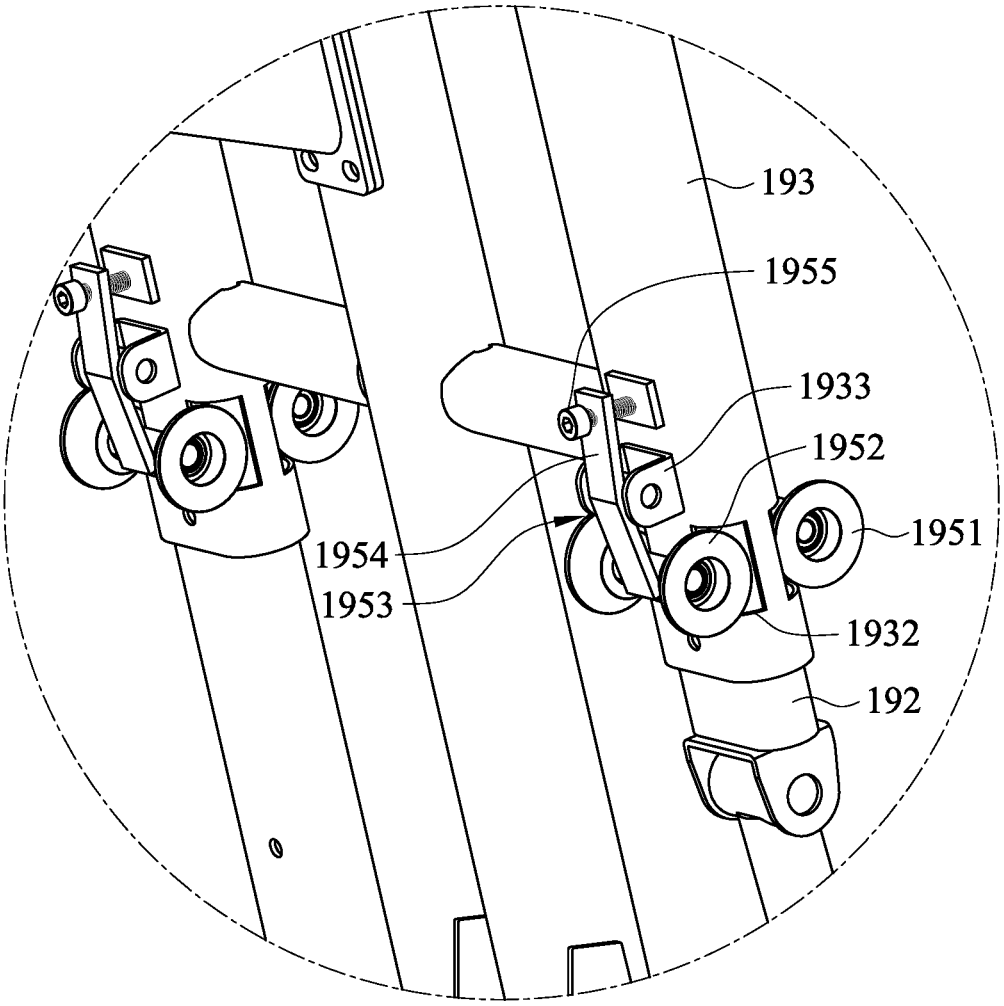
FIG. 7 is a partially perspective view showing the climbing assembly of the climbing machine according to the second embodiment of the present invention.

In the first embodiment shown in FIGS. 1-4, the inner tube 182 and the outer tube 183 are rectangle-shaped or square-shaped, but the inner tube 182 and the outer tube 183 may also have other shapes, such as circular, elliptical, or a shape combined with rectangle and arc. FIG. 5 is a perspective view showing a climbing machine 2 according to a second embodiment of the present invention. The second embodiment differs from the first embodiment in the configuration of the climbing assembly 19. FIGS. 6 and 7 are partially perspective views showing the climbing assembly 19 of the climbing machine 2 according to the second embodiment of the present invention.

Referring to FIGS. 5-7, in the present embodiment, the inner tube 192 and the outer tube 193 have an approximately elliptical profile. In addition, each adjusting assembly 195 includes two fixed wheels 1951, two adjusting wheels 1952, and an adjustment device 1953. In this embodiment, the two fixed wheels 1951 are pivotally mounted on the pedestal 1931 at a side of the outer tube 193, and the outer tube 193 includes openings 1932. The fixed wheel 1951 passes through one corresponded opening 1932 and matches the curved surface of the inner tube 192. The adjusting device 1953 is disposed on the outer surface of the outer tube 193 opposite to the fixed wheel 1951. The adjusting device 1953 includes an adjusting member 1954 and an adjusting bolt 1955. The adjusting member 1954 is pivotally disposed on the convex structure 1933 protruded from the surface of the outer tube 193. The adjusting bolt 1955 passes through the upper end of the adjusting member 1954 and is connected to the outer tube 193. The two adjusting wheels 1952 are pivotally mounted on the left side and right side of the lower end of the adjusting member 1954. The outer tube 193 has an corresponded opening 1932 through which the adjusting wheel 1952 passes, and the adjusting wheel 1952 abuts against the inner tube 192. Thereby, by rotating the adjusting bolt 1955, the gap or tightness between the adjusting wheel 1952 and the inner tube 192 can be adjusted.

Figure 8:
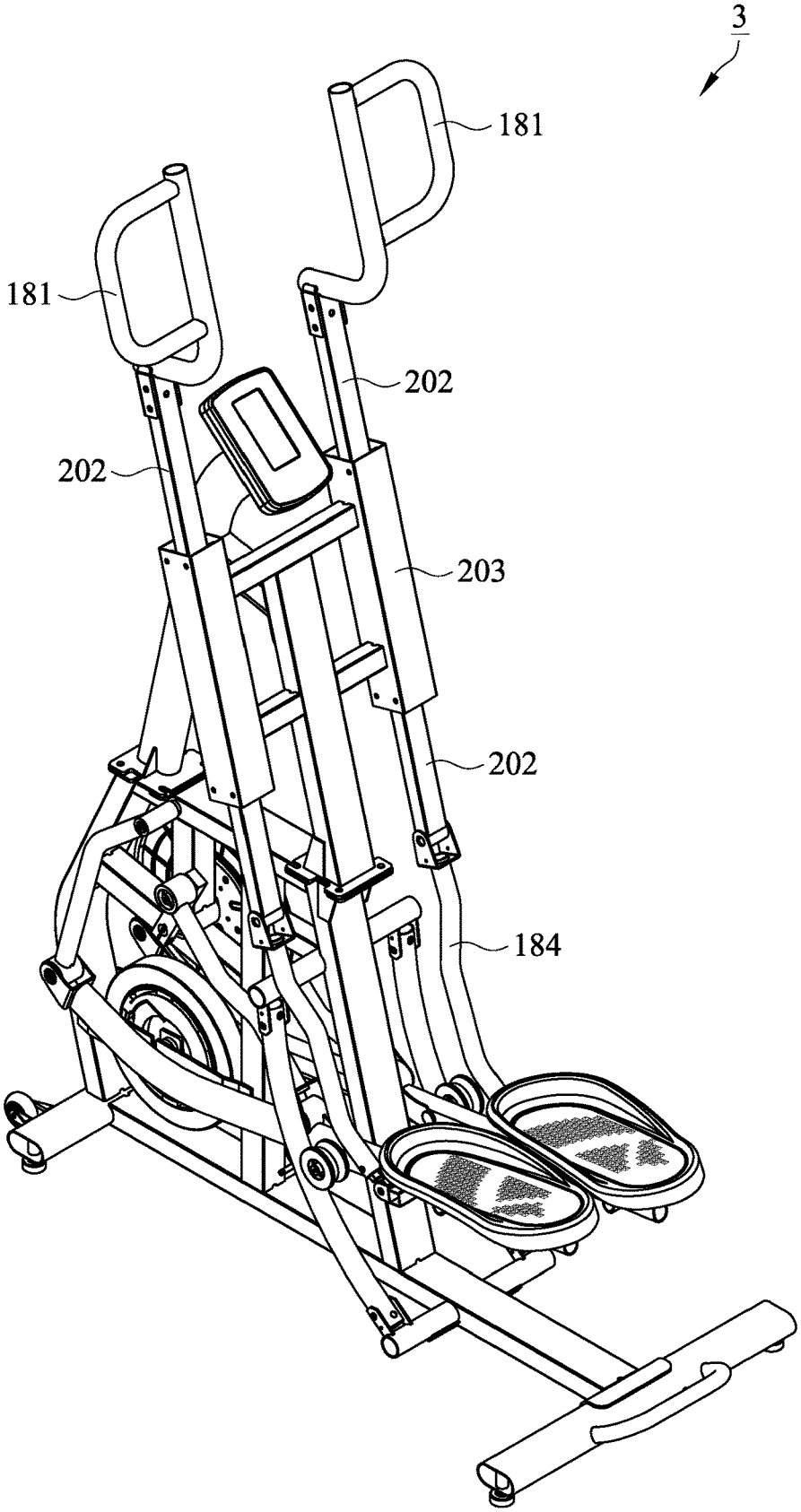
FIG. 8 is a perspective view showing a climbing machine according to a third embodiment of the present invention.

In the first embodiment and the second embodiment, the fixed wheels and the adjusting wheels are pivotally disposed on the outer tube, but the present invention is not limited thereto. FIG. 8 is a perspective view, and FIG. 9 is a partially perspective view showing a climbing machine 3 according to a third embodiment of the present invention.

Figure 9:
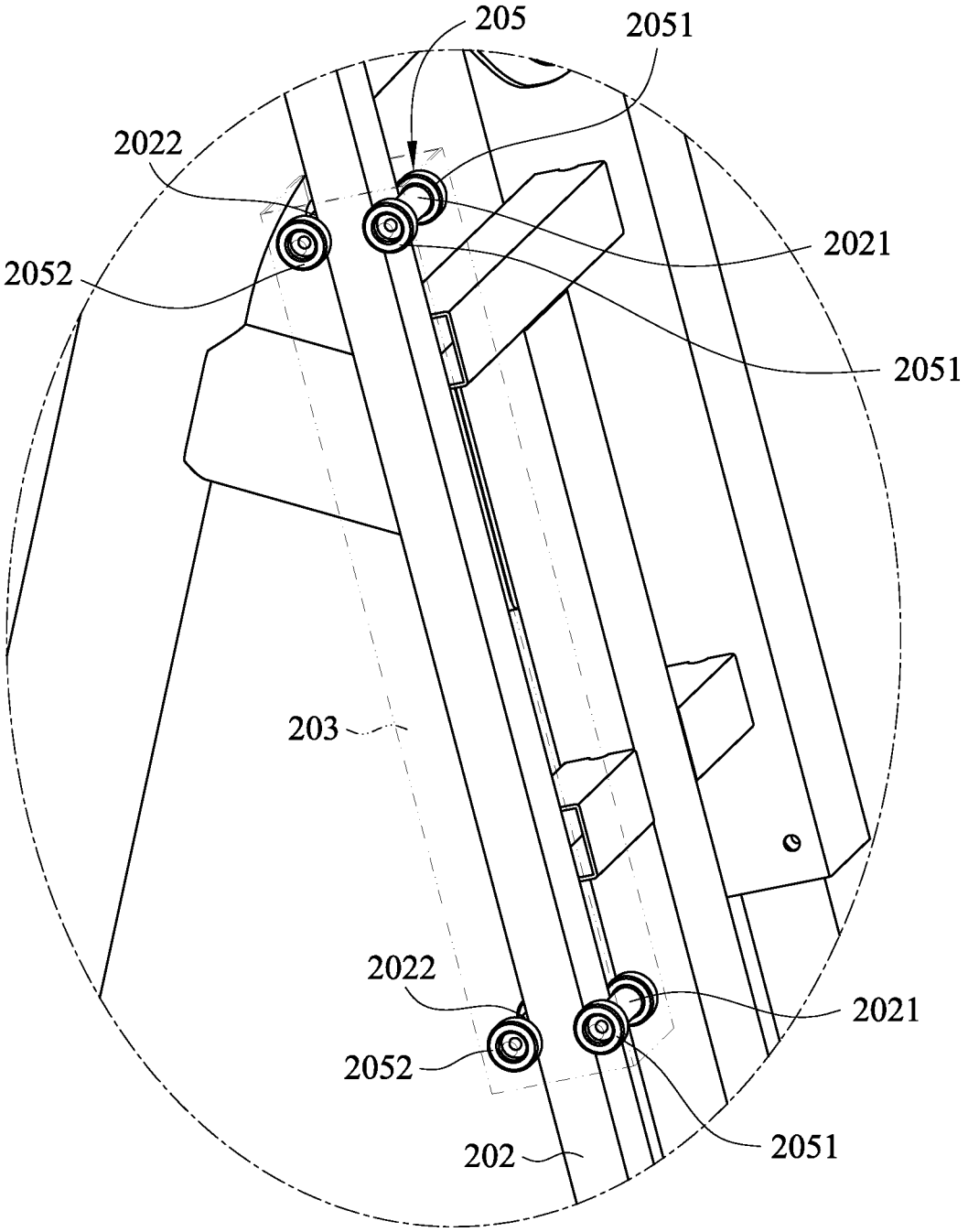
FIG. 9 is a partially perspective view showing the climbing assembly of the climbing machine according to the third embodiment of the present invention.

Referring to FIGS. 8-9, in the present embodiment, the inner tube 202 and the outer tube 203 have a rectangular or square profile. In addition, each adjusting assembly 205 includes two fixed wheels 2051 and two adjusting wheels 2052. In the present embodiment, the two fixed wheels 2051 are pivotally mounted on the pedestal 2021 on a side of the inner tube 202, and the fixed wheel 2051 is configured to fit the outer surface of the inner tube 202 and the inner surf ace of the outer tube 203. The two adjusting wheels 2052 are pivotally mounted on the pedestal 2022 at a side of the inner tube 202 opposite to the fixed wheel 2051, and the adjusting wheel 2052 is configured to fit the outer surface of the inner tube 202 and the inner surface of the outer tube 203.

Through the climbing machines 1/2/3 of the above embodiments of the present invention, the adjusting assembly of the climbing assembly 18/19/20 is rotatably connected between the inner tube and the outer tube, so that the inner tube can be maintained at an appropriate position and the friction between the inner tube and outer tube can be reduced.

According to the climbing machines provided by the present invention, the moving path of the pedals 17 is not limited to the configuration of the climbing assembly 18/19/20. For example, as shown in FIG. 2, although the moving path P1 of the handle 181 is limited by the straight configuration of the inner tube/outer tube, the moving path P2 of the pedal 17 can be an arc. Compared with the prior art, the operation of the climbing machine 1/2/3 of the present invention is more realistic. In some embodiments of this invention, the configuration of the inner tube/outer tube is arc-shaped such that the moving path P1 is also an arc, and the moving path P1 and the moving path P2 may be two arcs with different curvatures.

In addition, according to the climbing machines 1/2/3 provided by the present invention, the alternate up and down movements of the two climbing assemblies 18/19/20 are driven by the crank 14 through the connection between the pedal 17 and the axle 130 of the resistance device 13. The 180 degree arrangement of the two cranks 14 can drive the two climbing assemblies 18/19/20 to alternately move up and down. In contrast, conventional climbing machines make two handles to alternately move up and down through a belt or a steel rope. Compared with the prior art, the climbing machines of this invention have a fast response time, a smooth operation, and a wide range of resistance adjustment suitable for users with different body types.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

All of the contents of the preceding documents are incorporated herein by reference in their entireties. Although the disclosure herein refers to certain illustrated embodiments, it is to be understood that these embodiments have been presented by way of example rather than limitation. For example, any of the particulars or features set out or referenced. herein, or other features, including method steps and techniques, may be used with any other structure(s) and process described or referenced herein, in whole or in part, in any combination or permutation as a non-equivalent, separate, non-interchangeable aspect of this invention. Corresponding or related structure and methods specifically contemplated and disclosed herein as part of this invention, to the extent not mutually inconsistent as will be apparent from the context, this specification, and the knowledge of one skilled in the art, including, modifications thereto, which maybe, in whole or in part, (i) operable and/or constructed with, (ii) modified by one skilled in the art to be operable and/or constructed with, and/or (iii) implemented/made/used with or in combination with, any parts of the present invention according to this disclosure, include: (I) any one or more parts of the above disclosed or referenced structure and methods and/or (II) subject matter of any one or more of the inventive concepts set forth herein and parts thereof, in any permutation and/or combination, include the subject matter of any one or more of the mentioned features and aspects, in any permutation and/or combination.

Although specific embodiments have been illustrated and described, it will be appreciated by those skilled in the art that various modifications may be made without departing from the scope of the present invention, which is intended to be limited solely by the appended claims.

What is claimed is:

1. A climbing machine, comprising:

a frame comprising a base on a supporting plane or ground, a main frame on the base, and a supporting frame on the main frame;

two first rock arms respectively arranged at a left side and a right side of the frame, each first rock arm having a first end pivotally coupling with an axis of the main frame;

two second rock arms coupling with the two first rock arms, each first rock arm having a second end pivotally coupling with a first end of one corresponded second rock arm, each second rock arm having a roller at an outer side surface of the second rock arm;

two pedals coupling with the two second rock arms, each second rock arm having a second end coupling with one corresponded pedal;

a resistance device pivoted to the main frame by an axle for providing a resistance;

two cranks respectively arranged at a left side and a right side of the resistance device, each crank having a first end coupling with the axle of the resistance device;

two bridge rods coupling with the two cranks and the two second rock arms, each bridge rod having a first end and a second end, the first end of each bridge rod coupling with a second end of one corresponded crank, the second end of each bridge rod being pivoted to a first pivot of one corresponded second rock arm;

two sliding rods, each sliding rod having a first end coupled with the main frame and a second end coupled with the base, each second rock arm movably coupling with one corresponded sliding rod via the roller;

two climbing assemblies coupling with the two second rock arms, each climbing assembly comprising a handle, an inner tube, an outer tube, and a connecting rod, wherein the outer tube is fixed to a left side or a right side of the supporting frame, the inner tube is movably disposed in the outer tube, the handle is connected to an upper end of the inner tube, a lower end of the inner tube is pivotally connected to a first end of the connecting rod, and a second end of the connecting rod is pivoted to a second pivot of one corresponding second rock arm.

2. The climbing machine as recited in claim 1, wherein the second pivot comprises a rod end bearing.

3. The climbing machine as recited in claim 1, wherein each climbing assembly further comprises a plurality of adjusting assemblies, and each of the plurality of adjusting assemblies comprises a plurality of fixed wheels configured to fit an outer surface of the inner tube.

4. The climbing machine as recited in claim 3, wherein each adjusting assembly comprises:

two fixed wheels being pivotally mounted on a pedestal at a side of the outer tube, each of the two fixed wheels passing through a corresponded opening of the outer tube and being in contact with the inner tube;

two adjusting wheels being disposed on the outer surface of the outer tube opposite to the two fixed wheel; and an adjusting device coupling to the two adjusting wheels for adjusting a gap or tightness between the two adjusting wheels and the inner tube.

5. The climbing machine as recited in claim 4, wherein the adjusting device comprises:

an adjusting member being pivotally mounted on a convex structure protruded from surface of the outer tube; and an adjusting bolt passing through a first end of the adjusting member and connecting to the outer tube, the two adjusting wheels being pivotally mounted on a left side and a right side of a second end of the adjusting member, each adjusting wheel passing through one corresponded opening of the outer tube and abutting against the inner tube.

6. The climbing machine as recited in claim 4, wherein the inner tube and the outer tube are rectangle-shaped or square-shaped.

7. The climbing machine as recited in claim 4, wherein the inner tube and the outer tube are circle-shaped or ellipse-shaped.

8. The climbing machine as recited in claim 3, wherein each adjusting assembly comprises:

two fixed wheels being pivotally mounted on a first pedestal at a first side of outer surface of the inner tube; and two adjusting wheels being pivotally mounted on a second pedestal at a second side of outer surface of the inner tube, wherein the first side is opposite to the first side, and the two adjusting wheels are configured to fit the outer surface of the inner tube and the inner surface of the outer tube.

9. The climbing machine as recited in claim 1, wherein the resistance device comprises:

a driving wheel having the axle that includes a bidirectional bearing coupling with the first end of the two cranks; and a flywheel coupling to the driving wheel via a connecting member.

10. The climbing machine as recited in claim 1, wherein each of the two sliding rods is arc-shaped.

* * * * *